US006226022B1

(12) United States Patent
Morishima et al.

(10) Patent No.: US 6,226,022 B1
(45) Date of Patent: May 1, 2001

(54) SUBSTRATE AND IMAGE RECORDING APPARATUS USING THE SUBSTRATE

(75) Inventors: Ken Morishima, Suita; Akira Takeoka, Neyagawa, both of (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/302,579

(22) Filed: Apr. 30, 1999

(30) Foreign Application Priority Data

Sep. 29, 1998 (JP) ..... 10-275090

(51) Int. Cl.[7] ..... B41J 2/315
(52) U.S. Cl. ..... 347/212
(58) Field of Search ..... 347/171, 172, 347/175, 212; 369/112; 235/488

(56) References Cited

U.S. PATENT DOCUMENTS

| | | | | |
|---|---|---|---|---|
| 4,734,704 | | 3/1988 | Mizutani et al. | 347/173 |
| 5,111,033 | * | 5/1992 | Fujita et al. | 235/488 |
| 5,912,872 | * | 6/1999 | Feldman et al. | 369/112 |

FOREIGN PATENT DOCUMENTS

| | | |
|---|---|---|
| 59-144662 | 9/1984 | (JP) . |
| 3-77551 | 8/1991 | (JP) . |
| 5-227376 | 9/1993 | (JP) . |

OTHER PUBLICATIONS

English Language Abstract of JP–59–144662, Sep. 27, 1984.

English Language Abstract of JP–3–77551, Aug. 5, 1991.

English Language abstract of JP–5–227376, Sep. 3, 1993.

* cited by examiner

*Primary Examiner*—N. Le
*Assistant Examiner*—Anh T. N. Vo
(74) *Attorney, Agent, or Firm*—Greenblum & Bernstein, P.L.C.

(57) ABSTRACT

The light reflection pattern 22 is formed on a surface of the substrate 21. The light reflection pattern 22 is formed at an area that contains positions at which the Y lamp 12 and M lamp 13 are attached. The light reflection pattern 22 is composed of an ink layer by silk screen printing. The printing is performed along with other patterns such as an identification number, part name, and part attached position of the substrate 21. According to the constitution, it is possible to reduce the number of parts along with the number of assembling processes, and further possible to reduce the cost and labor time needed for the manufacturing and maintenance.

6 Claims, 9 Drawing Sheets

PRIOR ART

SUBSTRATE AND IMAGE RECORDING APPARATUS USING THE SUBSTRATE

BACKGROUND of THE INVENTION

1. Field of the Invention

The present invention relates to a substrate comprising a light reflection pattern for reflecting a light from a light source. The present invention further relates to an image recording apparatus using the substrate.

2. Description of the Related Art

As described in U.S. Pat. No. 4,734,704, a heat-sensitive recording material in which a magenta heat-sensitive coloring layer, a cyan heat-sensitive coloring layer and a yellow heat-sensitive coloring layer are sequentially laminated on a backing has been developed. Microcouples containing each coloring agent are dispersed in a respective coloring layer. Each coloring layer has a respective different coloring heat energy in this heat-sensitive recording material. Therefor it is possible to develop each color by providing a different heat energy on a respective coloring layer. Then, before a lower coloring layer is printed after an upper coloring layer is printed, the printed coloring layer is fixed by a wavelength light, for example, ultraviolet ray radiation, specific for the printed layer. This processing is called photo-fixing. The printing system using the above heat-sensitive recording material is called Thermo-Autochrom system.

The heat-sensitive recording material of the above Thermo-Autochrom system is different from a conventional sublimation heat transfer system and itself is colored, thereby it is not necessary to prepare a ink ribbon or ink cartridge other than the recording material. In addition, a protection layer is provided on the top of the recording material in order to provide a high resistance against affects from the external.

In a Thermo-Autochrom system printer, a thermal head first provides a heat energy to the heat-sensitive recording material to color only a yellow layer. Then the yellow layer is fixed by a phototube emitting a light of wavelength specified for the yellow layer. The thermal head next provides a heat energy to the heat-sensitive recording material to color only a magenta layer. Then the magenta layer is fixed by another phototube emitting a light of wavelength specified for the magnet layer. The thermal head finally provides a heat energy to the heat-sensitive recording material to color a cyan layer, then the heat-sensitive material is discharged to complete a full-color printing.

In the photo-fixing described above, when a light amount for a coloring layer is less than required, a desired color is not obtained because the coloring layer is colored again when the next coloring layer is colored. For example, when a light amount of the phototube to fix the yellow layer is less than required, the yellow color layer remains unfixed, and when the magenta layer is next heated to be colored, the unfixed yellow coloring layer is also colored. As a result, the obtained hue also contains a yellow component when the original data indicates only a magenta component, thereby resulting in more reddish hue.

In order to solve the lack of light amount, phototubes 111 and 112 are surrounded by a metal reflection plate 114 except for a side toward the recording material 113.

On the other hand, when a light amount for a desired coloring layer is more than required, the next coloring layer is sometimes fixed during the desired layer is fixed. In this case, the magenta layer is not colored enough when the heat energy for coloring the magenta layer is provided.

Therefore the emission light amount of the phototube is adjusted by measuring the light amount during the photo-fixing processing in order to always obtain the desired light amount. A light sensor such as photo-diode is used to measured the light amount. The light sensor is attached on the metal reflection plate 114 along with the sensor circuit.

However a harness is needed to attach the phototubes 111 and 112 on the metal reflection plate 114. Another harness is further needed to attach the light sensor and the sensor circuit on the metal reflection plate 114. The number of components are thereby increased, resulting in a higher cost and a more assembling processes.

SUMMARY OF THE INVENTION

It is an object of the present invention to provide a substrate for enabling the number of components and the number of assembling processes to be largely reduced so as to suppress the cost and the labor time.

The above object is achieved by a substrate comprising a light reflection pattern that is formed on the substrate and reflects a light from a light source.

According to the aforementioned aspect of the invention, it is possible to reduce the number of components along with the number of assembling processes.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENT

Figure 1:
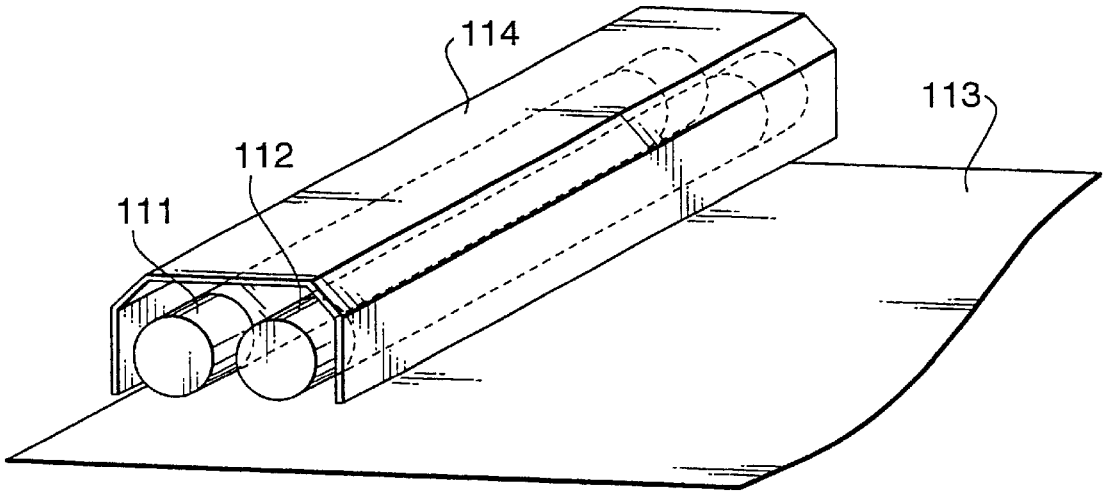
FIG. 1 is a schematic diagram illustrating a photo-fixing section of a conventional image recording apparatus.
Figure 2:
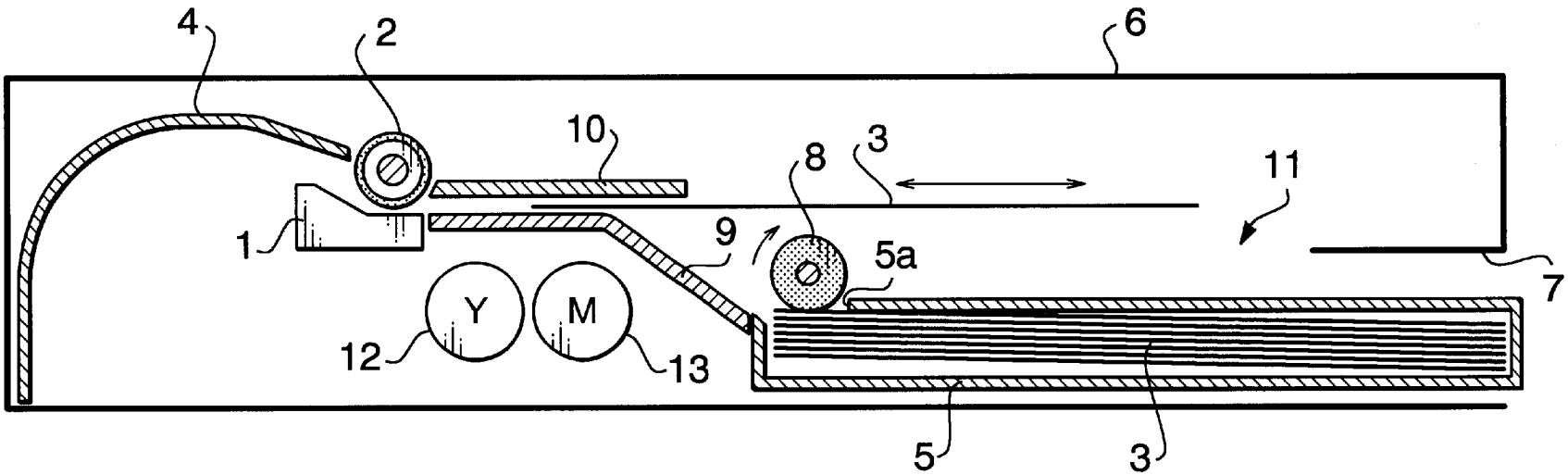
FIG. 2 is a side view illustrating a configuration of an image recording apparatus according to an embodiment of the present invention.
Figure 3:
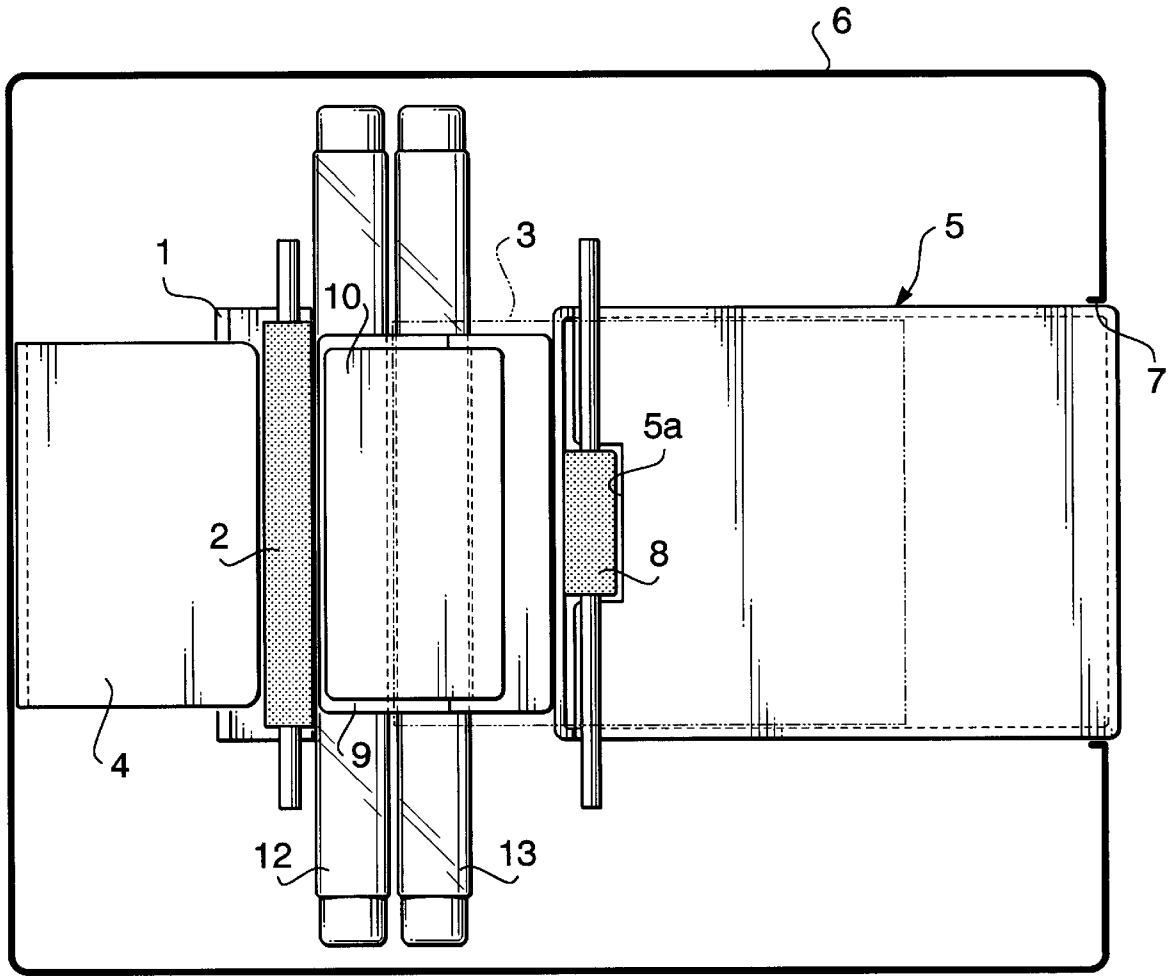
FIG. 3 is a plan view illustrating the configuration on of the image recording apparatus according to the above embodiment.

An embodiment of the present invention is described below with reference to the accompanying drawings. FIG. 2 and FIG. 3 are respectively a side view and a plan view illustrating a configuration of an image recording apparatus using a substrate according to the embodiment of the present invention.

A plurality of thermal elements are provided in a line arrangement on a thermal head 1. A platen roller 2 is provided facing to the thermal head 1. The platen roller 2 presses the recording paper 3 with a certain pressure to contact to the thermal head 1. The platen roller 2 further rotates by a driving section (not shown) to carry the recording paper.

The recording paper 3 is moved back and forth linearly between the thermal head 1 and the platen roller 2 by a paper carrying unit (not shown) with the rear edge of the paper held with the unit.

A guide material 4 for guiding the recording paper 3 is provided behind the thermal head 1 and platen roller 2.

A paper cassette 5 is provided under the recording paper 3 in a carrying area. In the paper cassette 5, a plurality of sheets of recording paper are stored in a layer condition with each recording surface faced downward. The paper cassette 5 is inserted from an opening section 7 provided on a front surface of a box 6 to be set.

An opening section 5*a* is formed on a top surface at the front end of the paper cassette 5. A feed roller 8 goes into the paper cassette 5 through the opening 5*a* when the paper cassette is set. The feed roller 8 rotates by a driving section (not shown) in order to supply the recording paper 3 from the paper cassette 5. A paper back side guide 9 is provided toward a space between the thermal head 1 and the platen roller 2 from around the feeding side of the feed roller 8. A paper upper side guide 10 is provided facing to the paper back side guide 9. The paper back side guide 9 is made of a clear resin material through which a light of wavelength of more than 300 nm is passed such as an acrylic resin containing no UV absorbents. The paper upper side guide 10 and the paper back side guide 9 guide the recording paper 3 to introduce to the space between the thermal head 1 and the platen roller 2.

A discharge space 11 is provided above the paper cassette 5 to discharge the printed recording paper 3.

Under the recording surface of the recording paper 3 just in front of the thermal head 1 and the platen roller 2, a yellow fixing fluorescent lamp (hereinafter referred to as Y lamp) 12 and a magenta fixing fluorescent lamp (hereinafter referred to as M lamp) 13 are sequentially provided along a wide direction of the recording paper 3.

Figure 4:
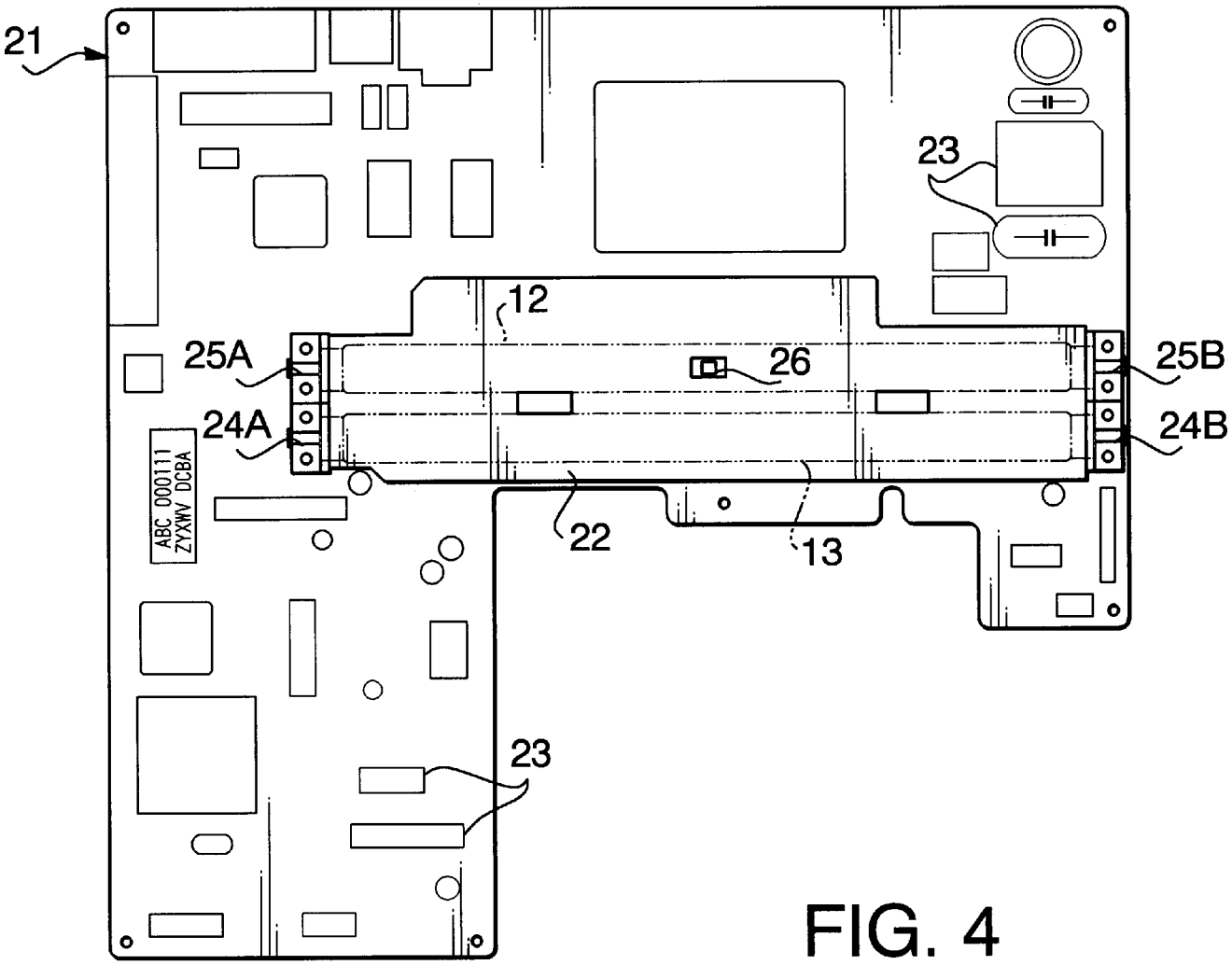
FIG. 4 is a plan view illustrating a substrate of the image recording apparatus according to the above embodiment.
Figure 5:
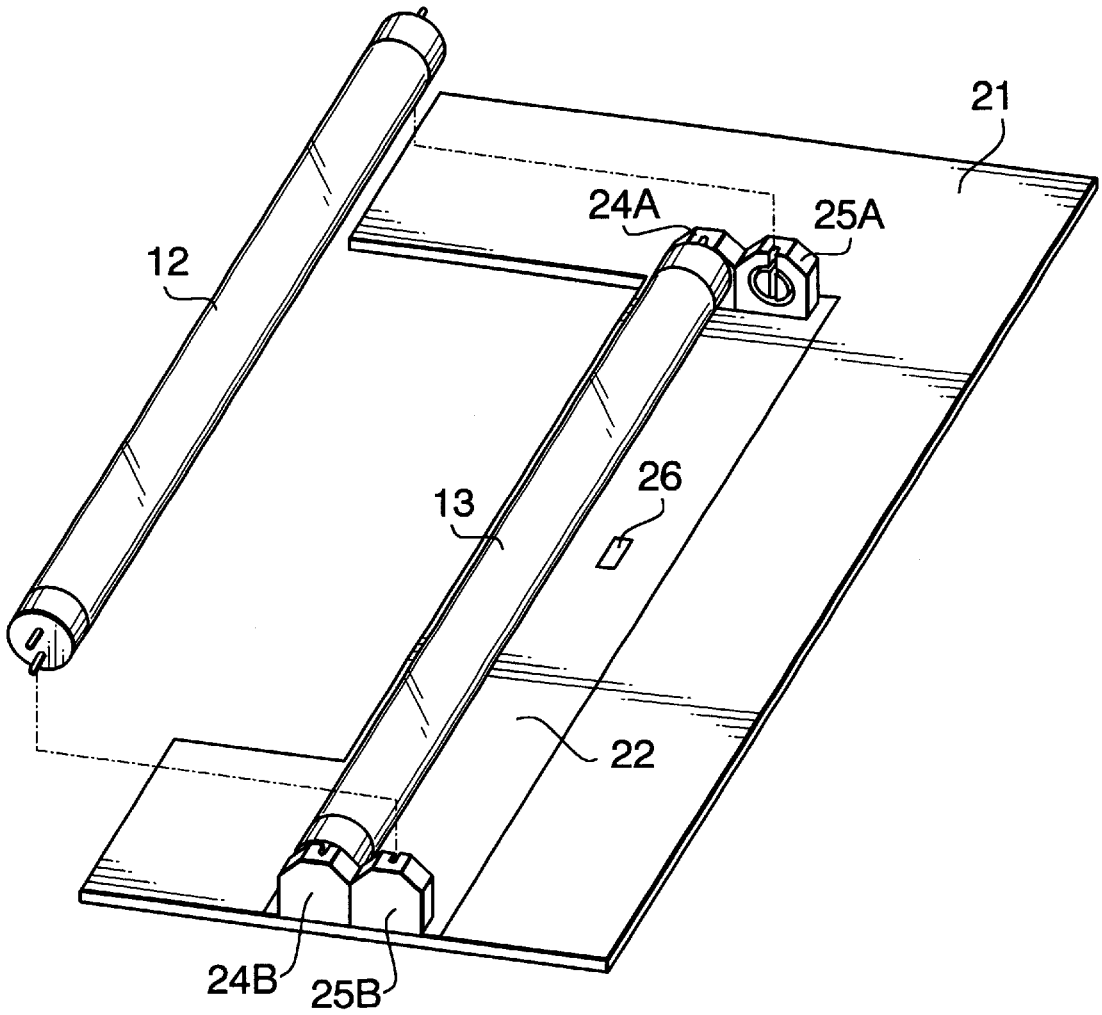
FIG. 5 is a perspective view illustrating a photo-fixing section of the image recording apparatus according to the above embodiment.
Figure 6:
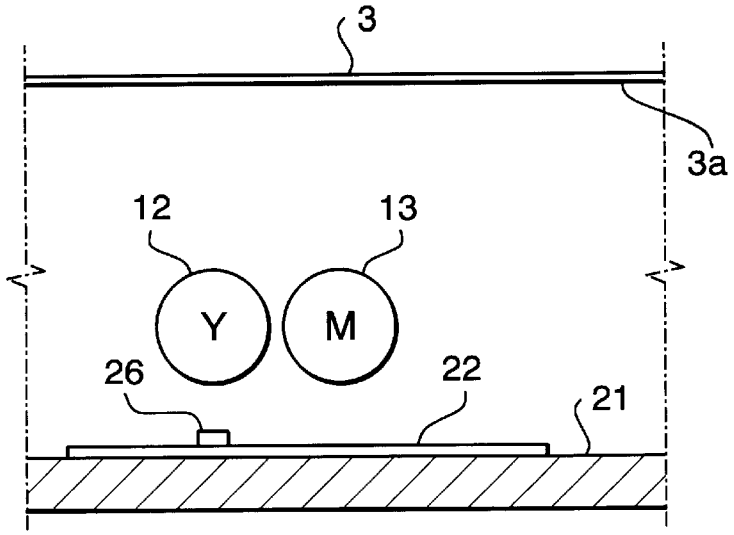
FIG. 6 is a schematic sectional view illustrating a peripheral around the photo-fixing section of the image recording apparatus according to the above embodiment.

FIG. 4 is a plan view illustrating a substrate according this embodiment. FIG. 5 is a perspective view illustrating a state where a fluorescent lamp is attached on the substrate according to this embodiment. A light reflection pattern 22 is formed on a surface of a substrate 21. The light reflection pattern 22 is formed at an area that contains positions at which the Y lamp 12 and M lamp 13 are attached as illustrated in FIG. 5.

The light reflection pattern 22 is composed of an ink layer by printing such as a silk screen printing. The printing is performed along with other patterns 23 such as an identification number, part name, and part attached position of the substrate 21. As a color of the ink layer, any color having a higher light reflectance than a color of the substrate 21 is available. It is white in this case. The light reflection pattern 22 may be composed of a metal thin film made by, for example, plating or spattering.

Two pairs of sockets of 24A, 24B and 25A, 25B by which the Y lamp 12 and the M lamp 13 are allowed to be attached and removed are provided in a connected row arrangement along the both side edges of the light reflection pattern 22.

The light reflection pattern 22 is positioned at the opposite side of the recording paper 3 with the Y lamp 12 and the M lamp 13 laid between those. According to the configuration, the light reflection pattern 22 irradiates the light that the Y lamp 12 and M lamp 13 emit toward the opposite side of the recording paper 3 toward the recording surface 3*a* of the recording paper 3.

Figure 8:
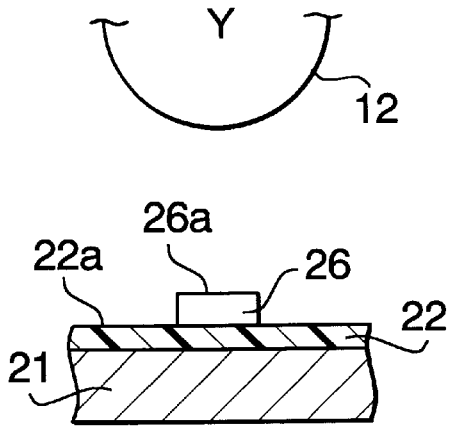
FIG. 8 is a schematic partial view illustrating a peripheral around a light sensor of the image recording apparatus according to the above embodiment.

A light sensor 26 is attached above the light reflection pattern 22. As illustrated in FIG. 8, a receiving surface 26*a* of the light sensor 26 is positioned closer to the Y lamp 12 than a light reflection surface 22*a* of the light reflection pattern 22. In addition, the receiving surface 26*a* is positioned far enough from the Y lamp so that the heat of the Y lamp seldom reaches.

Figure 7:
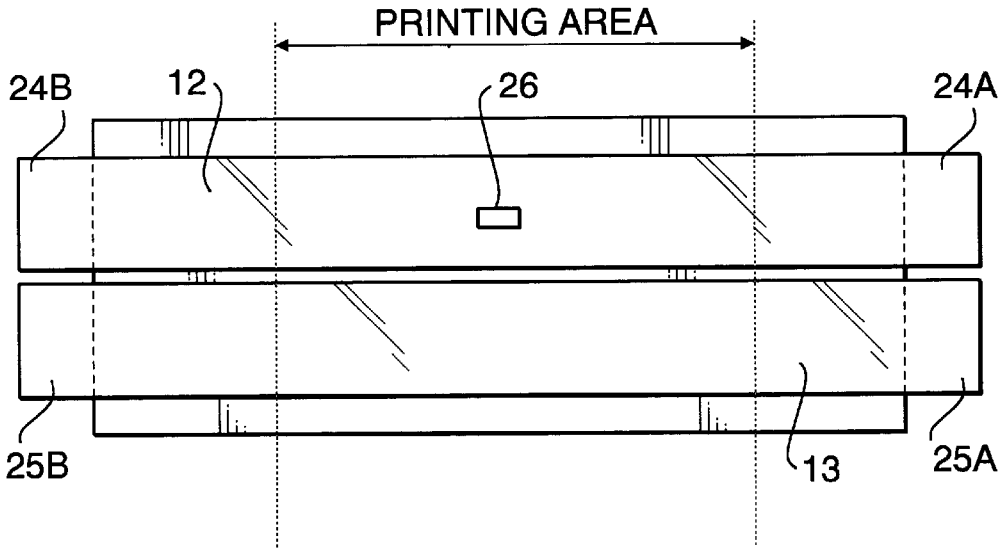
FIG. 7 is a schematic plan view illustrating a peripheral around the photo-fixing section of the image recording apparatus according to the above embodiment.

In addition, as illustrated in FIG. 7, the light sensor 26 is provided just under the Y lamp. In other words, the light sensor 26 is provided so that the Y lamp 12 hides the light sensor 26 under its shade when seeing from the side of the recording paper 3. In addition, the light sensor 26 is provided in a printing area through which the recording paper 3 passes, preferably in an almost center position of the printing area.

Figure 9:
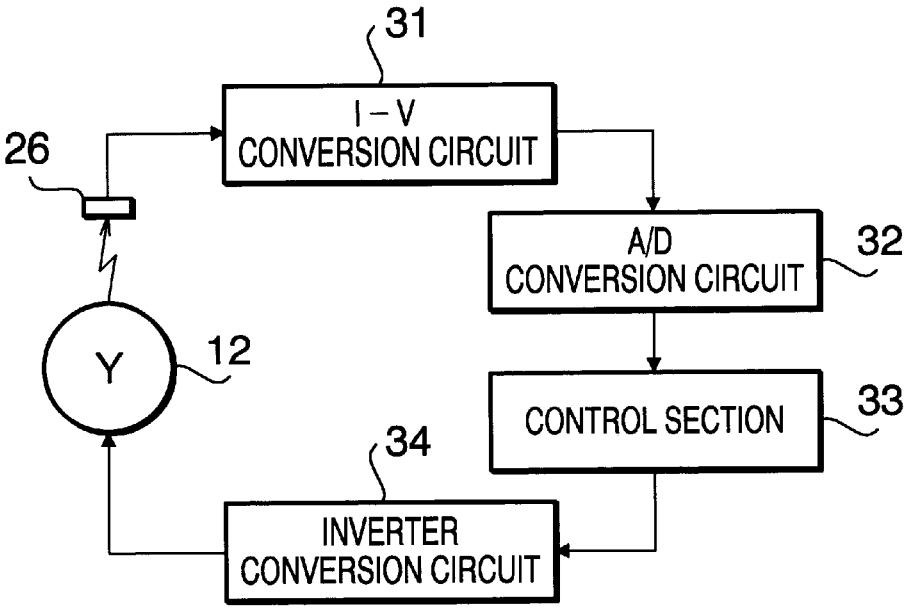
FIG. 9 is a block diagram illustrating a. configuration of a dimmer circuit of the image recording apparatus according to the above embodiment.

FIG. 9 is a block diagram illustrating a configuration of a dimmer circuit of the image recording apparatus according to this embodiment.

The light sensor 26 outputs a photoelectric current in proportion to an emission light amount of the Y lamp 12 to an I-V conversion circuit 31. The I-V conversion circuit 31 converts the photoelectric current into a voltage value to output to an A/D conversion circuit 32. The A/D conversion circuit 32 converts the voltage value into a digital signal to output to a control section 33.

The control section 33 compares the input voltage with a predetermined target voltage. Based on the comparison result, the control section 33 outputs a control value to change a duty ratio to an inverter circuit 34. Specifically, the control section 33 decreases the duty ratio when the input voltage is higher than the target volume, while increases the duty ratio when the input voltage is lower than the target value.

The inverter circuit 34 reduces or extends an ON time of a cycle of the Y lamp 12 with the duty ratio determined according to the control value from the control section 33. According to the dimmer processing described above, the light amount of the Y lamp is allowed to come close to the target value.

In addition, the Y lamp repeats flashing furiously at a high rate, however since the response frequency of the light sensor 26 is lower than the flashing of the Y lamp 12, the output of the light sensor 26 is leveled without varying.

Figure 10:
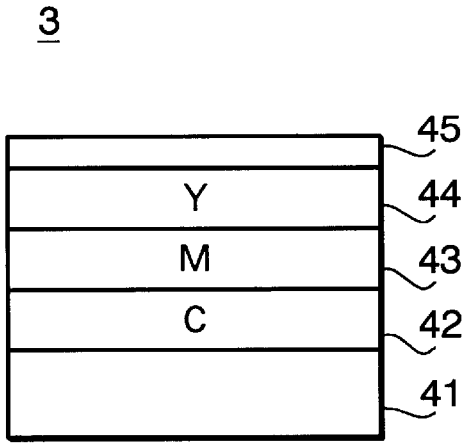
FIG. 10 is a sectional view illustrating recording paper used in the image recording apparatus according to the above embodiment.
Figure 11:
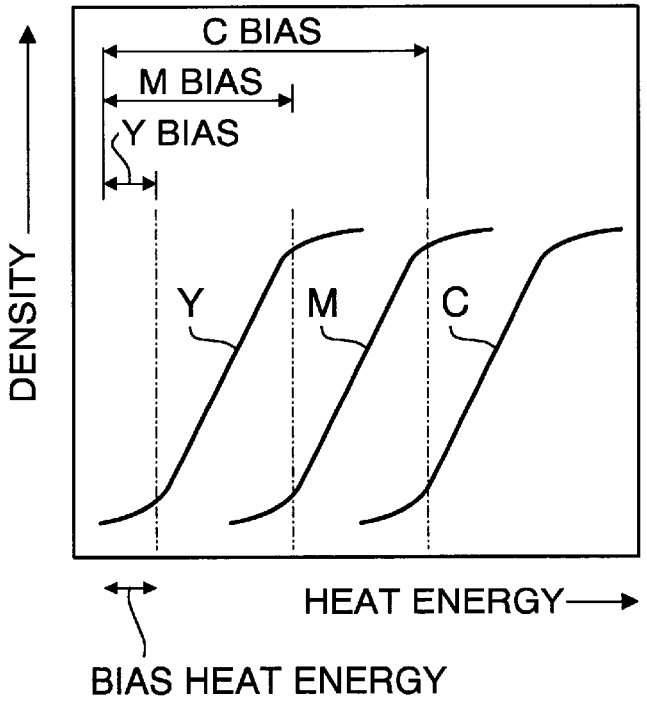
FIG. 11 is a characteristic diagram indicating coloring characteristics of coloring layers of the recording paper according to the above embodiment.

FIG. 10 is a sectional view illustrating recording paper 3 used in the image recording apparatus according to this embodiment. In addition, FIG. 11 is a characteristic diagram indicating coloring characteristics of coloring layers of the recording paper 3 according to this embodiment.

The recording paper 3 has a backing 41 on which a cyan coloring layer 42, a magenta coloring layer 43 and a yellow coloring layer 44 are sequentially laminated, and a protection layer 45 is further formed as a top layer.

Each of coloring layers 42 to 44 develops the color by respective heat-sensitive characteristic. According to the order of the yellow coloring layer 44 as the highest layer, the magenta coloring layer 43 and the cyan coloring layer as the lowest layer, the layer develops the color by higher temperature. The yellow coloring layer 42 and the magenta coloring layer 43 that develop the color by lower temperature than the cyan coloring layer are respectively irradiated by UV ray containing 420 nm or 365 nm wavelength respectively emitted from the Y lamp 12 and the M lamp 13 after the color is printed to fix the color of each of the coloring layers 42 to 44 in order to enable a full color printing. The Y lamp 12 used in fixing the yellow coloring layer 44 of the recording paper 3 has the fixing sensitivity characteristic that fixes the magenta coloring layer when the light amount is too strong.

According to the image recording apparatus configured as described above, since the light reflection pattern 22 for reflecting the light from the Y lamp and M lamp is formed on a surface of the substrate 21, it is possible to reduce the number of the parts along with the number of assembling processes.

In addition, the light reflection pattern 22 is printed with ink by, for example, screen printing along with the other patterns 23. According to the constitution, it is possible to form the light reflection pattern 22 only by changing a pattern layout in a printing process of the other patterns 23 that has been conventionally performed, resulting in no risk to make a manufacturing process of the substrate 21 remarkably complicated.

Figure 12:
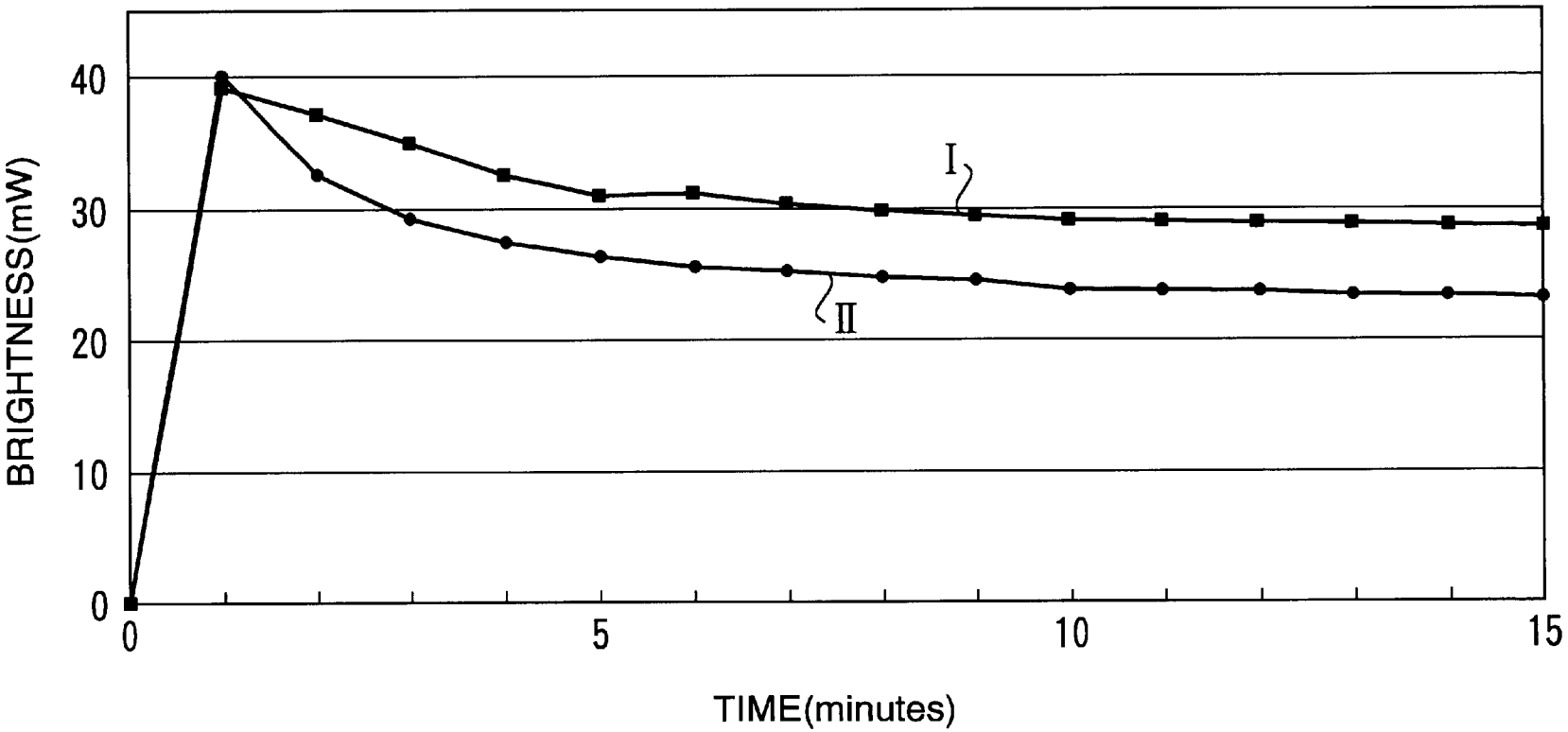
FIG. 12 is a characteristic diagram indicating a relationships of an illuminance and a light reflection material.

In addition, the light reflection pattern 22 composed of ink layer has a more excellent light reflection efficiency than the conventional metal reflection plate. FIG. 12 is a characteristic diagram indicating a relationships of an illuminance and a light reflection material. As been apparent from FIG. 12, the case of using the light reflection pattern composed of ink layer indicated by characteristic line I has a 20% light amount increase as compared with the case of using the reflection plate made of tin plate indicated by characteristic line II. According to the effect, it is possible to perform the photo-fixing assuredly and improve the image quality.

In addition, sockets 24A to 25B are attached on the substrate 21. The light sensor 26 and the sensor circuit are further provided on the substrate 21. Accordingly, since a harness and others are not needed, it is possible to reduce the number of parts along with the number of assembling processes as compared with the case of composing a fluorescent lamp, sockets, a metal reflection plate, a light sensor and a sensor circuit into a single unit.

The present invention is not limited to the above described embodiment. For example, the embodiment describes about a fixing apparatus for the Thermo-Autochrom material. However, it is possible to apply the present invention to a developing apparatus for developing a heat-sensitive recording material with a coloring layers that are colored by light.

As described above, according to the present invention, it is possible to reduce the cost and labor time needed for the manufacturing and maintenance.

The present invention is not limited to the above described embodiments, and various variations and modifications may be possible without departing from the scope of the present invention.

This application is based on the Japanese Patent Application No.HEI10-275090 filed on Sep. 29, 1998, entire content of which is expressly incorporated by reference herein.

What is claimed is:

1. A substrate structure comprising:

a substrate;

a light reflection region on a surface of said substrate, said light reflection region comprising a visible printed shape comprising visible identification indicia including at least one of an identification number, a part name and a part attaching position on the substrate, said light reflection region further comprising a printed shape that reflects light from a light source, said printed shape and said visible printed shape utilizing a common material, said printed shape being provided together with said visible printed shape.

2. The substrate of claim 1, further comprising a light sensor attached to said substrate that senses an amount of light from the light source.

3. The substrate of claim 1, further comprising a light source connection member that selectively secures the light source to said substrate, said light source connection member being provided on the surface of said substrate so as to place the light source above said printed shape.

4. A substrate structure of claim 1, said common material comprising an ink.

5. The image recording apparatus of claim 4, further comprising a light sensor attached to said substrate that senses an amount of light irradiated from said light source.

6. An image recording apparatus, comprising:

a light source that emits light towards a recording material;

a substrate on which said light source is mounted;

a light reflection region on a surface of said substrate, said light reflection region comprising a visible printed shape comprising visible identification indicia including at least one of an identification number, a part name and a part attaching position on the substrate, said light reflection region further comprising a printed shape that reflects light from a light source, said printed shape and said visible printed shape utilizing a common material, said printed shape being provided together with said visible printed shape.

* * * * *